US012753946B2

(12) United States Patent
Cho et al.

(10) Patent No.: US 12,753,946 B2
(45) Date of Patent: Oct. 6, 2026

(54) CEILING TYPE AIR CLEANER

(71) Applicant: Samsung Electronics Co., Ltd., Suwon-si (KR)

(72) Inventors: Sungjin Cho, Suwon-si (KR); Hyungmo Koo, Suwon-si (KR); Joonhyoung Kim, Suwon-si (KR); Kyeongae Lee, Suwon-si (KR); Sungjune Cho, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 710 days.

(21) Appl. No.: 18/191,771

(22) Filed: Mar. 28, 2023

(65) Prior Publication Data

US 2023/0235917 A1 Jul. 27, 2023

Related U.S. Application Data

(63) Continuation of application No. PCT/KR2021/012350, filed on Sep. 10, 2021.

(30) Foreign Application Priority Data

Nov. 5, 2020 (KR) ..... 10-2020-0146605

(51) Int. Cl.
*F24F 1/0047* (2019.01)
*F24F 13/08* (2006.01)
*F24F 13/20* (2006.01)

(52) U.S. Cl.
CPC ..... *F24F 13/085* (2013.01); *F24F 1/0047* (2019.02); *F24F 13/20* (2013.01)

(58) Field of Classification Search
CPC ..... F24F 13/085; F24F 1/0047; F24F 13/20; F24F 1/0073; F24F 13/28; F24F 1/035
(Continued)

(56) References Cited

U.S. PATENT DOCUMENTS 5,958,114 A * 9/1999 Sunahara ..... F24F 1/008 96/417
11,143,419 B2 10/2021 Seki et al.
(Continued)

FOREIGN PATENT DOCUMENTS

EP 1980799 B1 1/2011
EP 2058600 B1 8/2015
(Continued)

OTHER PUBLICATIONS

International Search Report and Written Opinion of the International Searching Authority dated Jan. 3, 2022, in connection with International Application No. PCT/KR2021/012350, 11 pages.
(Continued)

*Primary Examiner* — Avinash A Savani
*Assistant Examiner* — Ryan L Faulkner

(57) ABSTRACT

A ceiling type air cleaner comprises a housing comprising an opening arranged on a lower side of the housing; a filter arranged on a side of the opening; and an edge plate arranged on the lower side of the housing to support the filter and comprising a locking portion configured to lock the filter to the housing and unlock the filter from the housing. The locking portion comprises a space portion forming a space inside the edge plate; a sliding member configured to slide along the space portion; a fitting member configured to allow the sliding member to be fixed to or released from the space portion so as to allow the sliding member to slide; and a link configured to rotate according to the sliding of the sliding member so as to lock the filter to the housing or unlock the filter from the housing.

18 Claims, 15 Drawing Sheets

(58) Field of Classification Search
USPC ..... 454/251
See application file for complete search history.

(56) References Cited

U.S. PATENT DOCUMENTS

| | | | | |
|---|---|---|---|---|
| 2003/0150196 | A1* | 8/2003 | Duffy | B01D 46/001 55/497 |
| 2005/0186901 | A1* | 8/2005 | Moore | F24F 13/04 55/385.2 |
| 2009/0165432 | A1* | 7/2009 | Yabu | F24F 13/20 55/480 |
| 2009/0193769 | A1* | 8/2009 | Mun | F24F 1/0047 55/289 |
| 2010/0159818 | A1* | 6/2010 | Sakashita | F24F 1/0047 454/233 |
| 2019/0368751 | A1 | 12/2019 | Seki et al. | |
| 2020/0049371 | A1 | 2/2020 | Yamaguchi et al. | |

FOREIGN PATENT DOCUMENTS

| | | | |
|---|---|---|---|
| EP | 2163831 | B1 | 11/2018 |
| JP | 3795957 | B2 | 7/2006 |
| JP | 2008-057881 | A | 3/2008 |
| JP | 2008-064342 | A | 3/2008 |
| JP | 4226864 | B2 | 2/2009 |
| JP | 4818058 | B2 | 11/2011 |
| JP | 5216427 | B2 | 6/2013 |
| JP | 2014-105959 | A | 6/2014 |
| JP | 6008714 | B2 | 10/2016 |
| JP | 6135739 | B2 | 5/2017 |
| JP | 2018-031561 | A | 3/2018 |
| JP | 6343453 | B2 | 6/2018 |
| JP | 6716007 | B2 | 7/2020 |
| JP | 6735847 | B2 | 8/2020 |
| KR | 20-0297796 | Y1 | 12/2002 |
| KR | 10-2003-0043039 | A | 6/2003 |
| KR | 10-0881250 | B1 | 2/2009 |
| KR | 10-1065783 | B1 | 9/2011 |
| WO | 2018098958 | A1 | 6/2018 |

OTHER PUBLICATIONS

Notice of Preliminary Rejection dated Feb. 27, 2025, in connection with Korean Application No. 10-2020-0146605, 13 pages.

* cited by examiner

CEILING TYPE AIR CLEANER

CROSS-REFERENCE TO RELATED APPLICATIONS

This application is a Bypass Continuation of International Application No. PCT/KR2021/012350, filed Sep. 10, 2021, which claims priority to Korean Patent Application No. 10-2020-0146605, filed Nov. 5, 2020, the disclosures of which are herein incorporated by reference in their entirety.

BACKGROUND

1. Field

The present disclosure relates to a ceiling type air cleaner including a locking portion configured to lock and unlock a filter.

2. Description of Related Art

An air cleaner is a device used to remove pollutants in the air. The air cleaner may remove germs, viruses, molds, and fine dust included in the suctioned air and chemicals that cause odors.

The air cleaner may include a filter for purifying contaminated indoor air. While the air sucked into the air cleaner passes through the filter, contaminants in the air may be removed and thus the contaminated air may be purified into clean air. Accordingly, the clean air may be discharged to the outside of the air cleaner.

When the air cleaner operates for a predetermined period of time and dust accumulates on the filter, a user needs to clean the filter or replace the filter with a new filter after separating the filter from a housing.

SUMMARY

The present disclosure is directed to providing a ceiling type air cleaner including a locking portion configured to lock and unlock a filter.

Further, the present disclosure is directed to providing a ceiling type air cleaner capable of preventing a fall of a fitting member by not completely disassembling the fitting member of a locking portion even when unlocking the filter.

One aspect of the present disclosure provides a ceiling type air cleaner including a housing including an opening arranged on a lower side of the housing, a filter arranged on a side of the opening, and an edge plate arranged on the lower side of the housing to support the filter and including a locking portion configured to lock the filter to the housing and unlock the filter from the housing.

The locking portion may include a space portion forming a space inside the edge plate, a sliding member configured to slide along the space portion, a fitting member configured to allow the sliding member to slide by being fixed to or released from the space portion, and a link configured to rotate according to the sliding of the sliding member so as to lock the filter to the housing or unlock the filter from the housing.

The ceiling type air cleaner may further include a fitting member configured to allow the sliding member to slide by being fixed to or released from the space portion. The edge plate may include a fastening hole configured to receive the fitting member so as to fasten the fitting member at the space portion.

The fitting member may include a body inserted into the fastening hole, and a head having a larger diameter than the body. The sliding member may include a first through hole provided to correspond to the head of the fitting member, and a second through hole connected to the first through hole and provided to be smaller than the first through hole and larger than the body.

A first screw thread may be provided on an outer surface of the body of the fitting member, and a second screw thread corresponding to the first screw thread may be provided on an inner surface of the fastening hole.

In response to inserting the fitting member into the fastening hole in a manner that the head of the fitting member is positioned in the first through hole, the sliding member may be fixed to the space portion.

In response to moving the fitting member from the fastening hole to allow the head of the fitting member to protrude from the first through hole, the sliding member may slide in a first direction along the space portion.

The link may be configured to couple to a first shaft coupler of the sliding member on a rear surface of the edge plate, and may be rotated with respect to the first shaft coupler.

A guide protrusion configured to limit rotation of the link may be arranged on the rear surface of the edge plate, and the link may include a guide hole into which the guide protrusion is fitted.

A portion of the link may be positioned to overlap the filter in a state in which the sliding member is fixed, and in response to the sliding member sliding in the first direction, the link may be configured to rotate so as not to overlap the filter and release the fixing of the edge plate.

In response to the sliding member sliding in a second direction opposite to the first direction, the link may be configured to rotate to a position to overlap the filter.

In response to fastening the fitting member to the fastening hole to allow the first head to be positioned in the first through hole, the link may be configured to support the filter.

The ceiling type air cleaner may further include an auxiliary frame arranged on a rear side of the link to support an edge of the filter.

The ceiling type air cleaner may further include a fixing frame fixed to the edge frame to be arranged on a front side of the link so as to fix the auxiliary frame and the filter.

The locking portion may further include a support member provided in such a way that one side thereof is coupled to the first shaft coupler to support the link and the other side thereof is coupled to a second shaft coupler of the sliding member so as to move together with the sliding member.

Another aspect of the present disclosure provides a ceiling type air cleaner including a housing including an opening arranged on a lower side, a filter arranged on one side of the opening, and an edge plate arranged on the lower side of the housing to support the filter and including a locking portion configured to allow the filter to be locked to or unlocked from the housing.

A fastening hole may be formed on an inner side of the edge plate. The locking portion may include a sliding member configured to slide so as to allow the filter to be locked to or unlocked from the housing, and a fitting member inserted into the fastening hole and configured to fix the sliding member or release the fixing of the sliding member.

The fitting member may include a body inserted into the fastening hole, and a head having a larger diameter than the body. The sliding member may include a first through hole provided to correspond to the head of the fitting member, and a second through hole connected to the first through hole and provided to be smaller than the first through hole and larger than the body.

In response to the fitting member being inserted into the fastening hole and in response to the head of the fitting member being positioned in the first through hole, the sliding member may be fixed to the edge plate.

In response to the fitting member being moved from the fastening hole to allow the head of the fitting member to protrude from the first through hole, the sliding member may slide along the edge plate.

Another aspect of the present disclosure provides a ceiling type air cleaner including a housing including a plurality of openings arranged on a lower side, a filter arranged on a side of the plurality of openings, a fan configured to move air passing through the filter, and an edge plate provided to correspond to an edge of the housing formed along the plurality of openings.

The edge plate may include a locking portion configured to allow the filter to be locked to or unlocked from the housing.

The housing may include a housing rib provided to define the plurality of openings, and the edge plate may include an edge plate rib provided at a position corresponding to the housing rib.

A ceiling type air cleaner may easily lock and unlock a filter through a sliding member of a locking portion.

Further, when unlocking a filter, a fitting member of a locking portion may be not completely disassembled so as to prevent the fitting member from falling.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
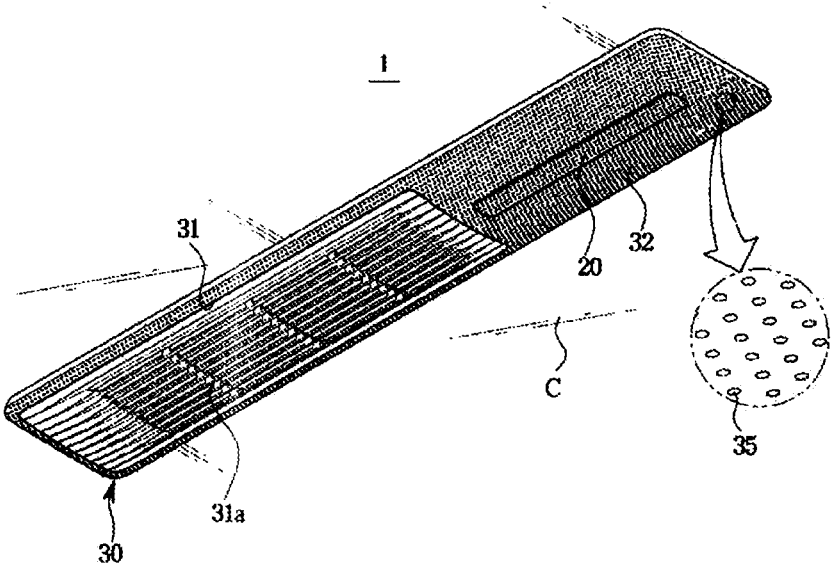
FIG. 1 is a view illustrating an air cleaner according to one embodiment of the present disclosure.

FIGS. 1 through 15, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Embodiments described in the disclosure and configurations shown in the drawings are merely examples of the embodiments of the disclosure, and may be modified in various different ways at the time of filing of the present application to replace the embodiments and drawings of the disclosure.

In addition, the same reference numerals or signs shown in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof. Shapes and sizes of elements in the drawings may be exaggerated for clear description.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

Hereinafter embodiments according to the disclosure will be described in detail with reference to the accompanying drawings.

Figure 2:
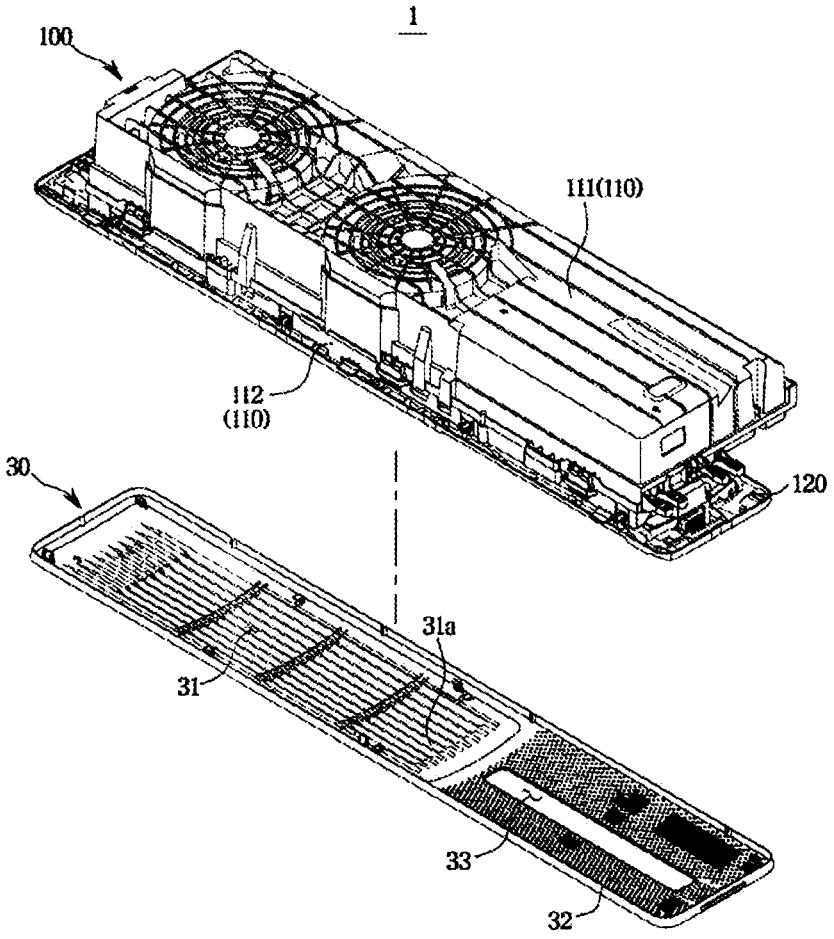
FIG. 2 is a view illustrating the air cleaner when viewed from the top after disassembling a grille of FIG. 1.
Figure 3:
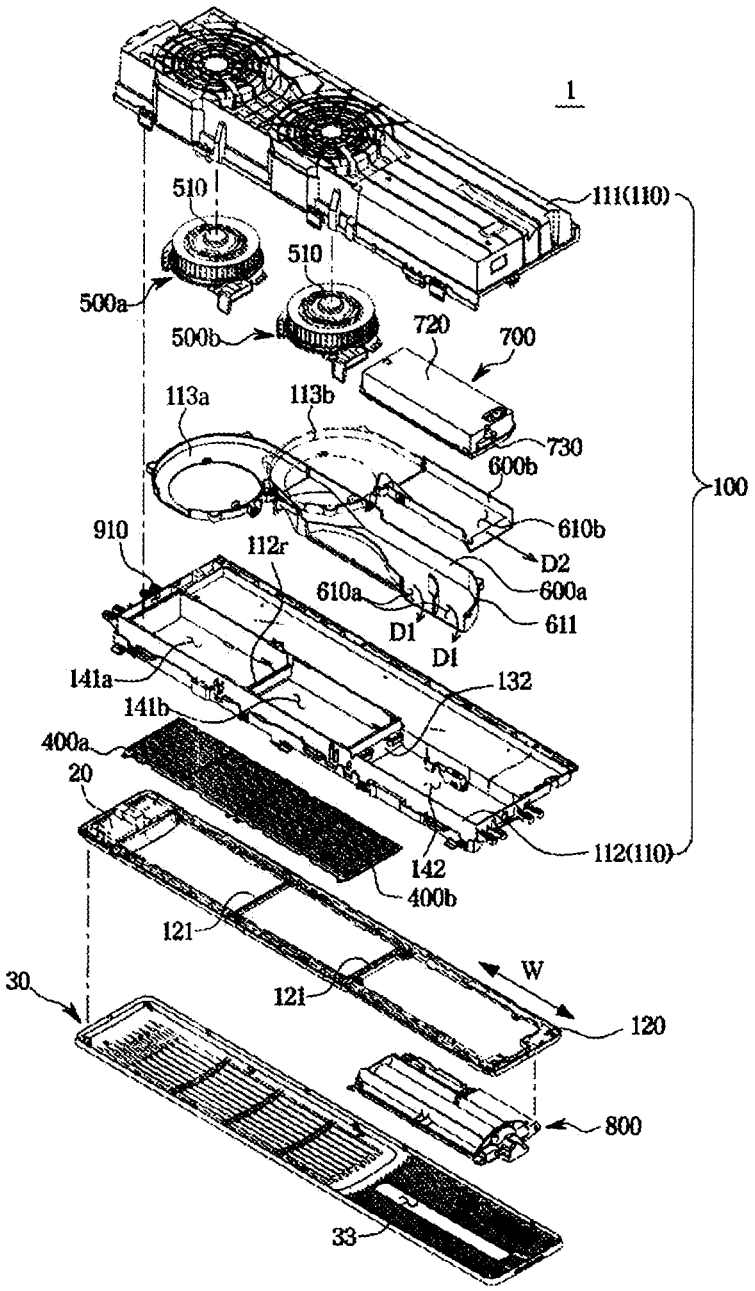
FIG. 3 is an exploded perspective view of the air cleaner according to one embodiment of the present disclosure.
Figure 4:
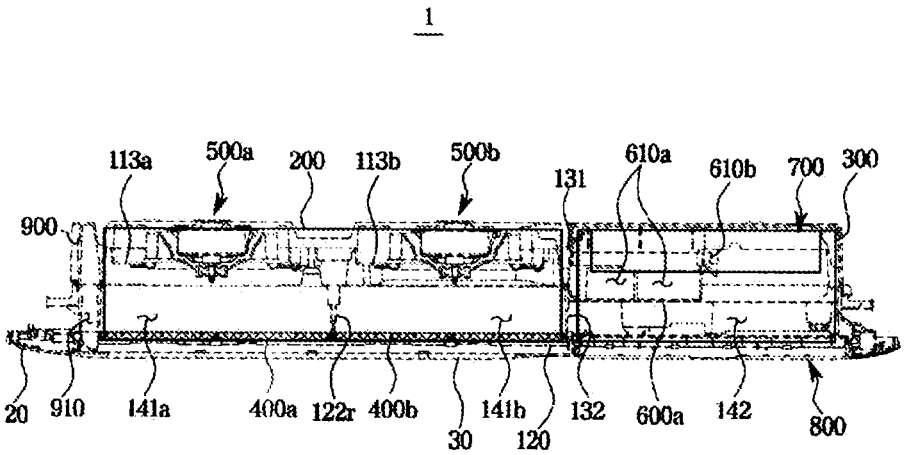
FIG. 4 is a cross-sectional view illustrating a filtration space and a convergence space of the air cleaner according to one embodiment of the present disclosure.
Figure 5:
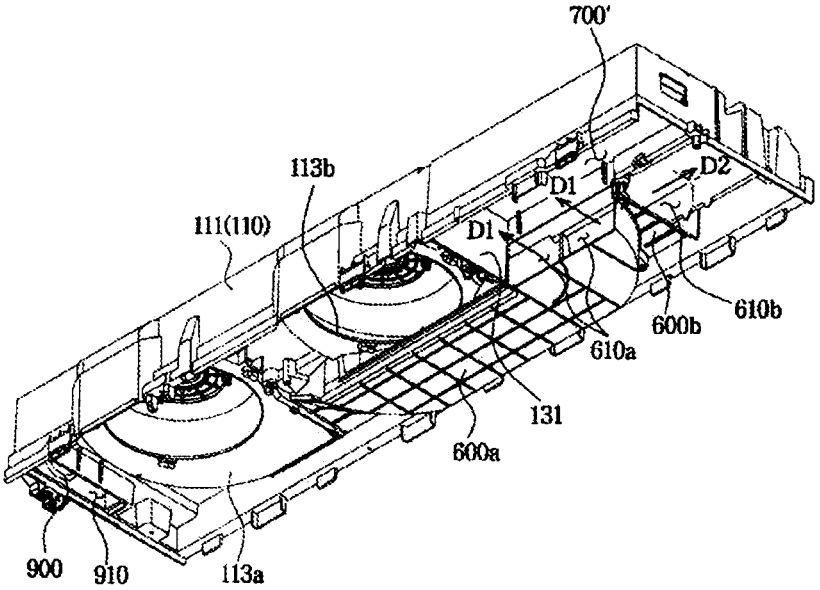
FIG. 5 is a perspective view illustrating a combination of a first body housing, a flow path and a fan guard of FIG. 3.
Figure 6:
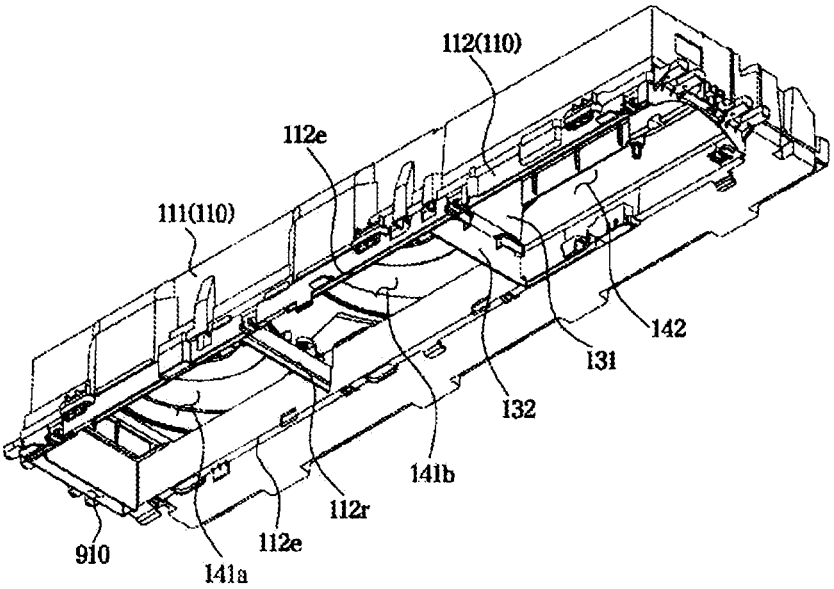
FIG. 6 is a perspective view illustrating a combination of the first body housing and a second body housing of FIG. 3.

FIG. 1 is a view illustrating an air cleaner according to one embodiment of the present disclosure, FIG. 2 is a view illustrating the air cleaner when viewed from the top after disassembling a grille of FIG. 1, FIG. 3 is an exploded perspective view of the air cleaner according to one embodiment of the present disclosure, FIG. 4 is a cross-sectional view illustrating a filtration space and a convergence space of the air cleaner according to one embodiment of the present disclosure, FIG. 5 is a perspective view illustrating a combination of a first body housing, a flow path and a fan guard of FIG. 3, and FIG. 6 is a perspective view illustrating a combination of the first body housing and a second body housing of FIG. 3.

For convenience of description, FIG. 6 illustrates that the first body housing and the second body housing are coupled after omitting the flow path and the fan guard of FIG. 5.

Referring to FIGS. 1 and 3, an air cleaner 1 may include a housing 100, filters 400*a* and 400*b*, fans 500*a* and 500*b*, and a grille 30.

The air cleaner 1 may further include a discharge assembly 800 through which filtered air is discharged from an inside of the housing 100 to an outside of the housing 100. The discharge assembly 800 may be provided to control the discharge airflow of the filtered air. The discharge assembly 800 may be rotatably coupled to the housing.

The air cleaner 1 may further include flow paths 600*a* and 600*b* through which air passing through the fans 500*a* and 500*b* flows to the discharge assembly 800.

The air cleaner 1 may include an electrical portion 700 including an electrical component (not shown) configured to drive and control components. Referring to FIG. 3, the electrical portion 700 includes an electrical box 720 in which electrical components are disposed and an electrical cover 730 covering the electrical components to prevent the electrical component from being exposed to an outside of the electrical portion 700. The electrical cover 730 may be coupled to the electrical box 720.

The air cleaner 1 according to the embodiment of the present disclosure may be installed on a ceiling C. At least a portion of the air cleaner 1 may be embedded in the ceiling C. Particularly, the housing of the air cleaner 1 may be embedded in the ceiling C.

The grille 30 may be provided to cover the filters 400*a* and 400*b* and the discharge assembly 800 coupled to the housing 100. The grille 30 may be coupled to the lower side of the air cleaner 1. The grille 30 may include a filter corresponding region 31 formed to correspond to the filters 400*a* and 400*b*. The grille 30 may further include a discharge assembly corresponding region 32 corresponding to the discharge assembly 800. The grille 30 may further include a blade opening 33 through which a discharge blade 820 of the discharge assembly 800 is exposed to the outside. The filter corresponding region 31 may further include a grille blade 31*a* to allow outside air introduced into the air cleaner 1 to smoothly flow.

A plurality of fine holes 35 formed around the blade opening 33 may be provided in the discharge assembly corresponding region 32.

Referring to FIGS. 2 to 6, the housing 100 may be formed in a box shape that is open downward to receive components of the air cleaner 1. The housing 100 may include openings 141*a*, 141*b*, and 142 (refer to FIG. 6) at a lower side.

The housing 100 may include a body housing 110 disposed inside the ceiling C. The body housing 110 may include a first body housing 111 and a second body housing 112. The second body housing 112 may be coupled under the first body housing 111. The first body housing 111 and the second body housing 112 may be separately manufactured and combined for the efficiency of the manufacturing process of the air cleaner 1. The first body housing 111 and the second body housing 112 may be coupled to form the above-described box shape that is open downward. However, it is not limited thereto, and the first body housing 111 and the second body housing 112 may be integrally formed with each other.

Referring to FIG. 4, the inside of the housing 100 may be divided into a filtration space 200 and a convergence space 300. The filtration space 200 and the convergence space 300 may be defined by partition plates 131 and 132. The partition plates 131 and 132 may include a first partition plate 131 and a second partition plate 132. The first partition plate 131 may be formed on the first body housing 111. The second partition plate 132 may be formed on the second body housing 112. However, it is not limited thereto, and as the first body housing 111 and the second body housing 112 are integrally formed, the first partition plate 131 and the second partition plate 132 may also be integrally formed in the same manner.

The filtration space 200 may be defined as a space in which air outside the air cleaner 1 passes through the filters 400*a* and 400*b* and then flows into the fans 500*a* and 500*b*. The convergence space 300 may be defined as a space in which filtered air passing through the fans 500*a* and 500*b* is accommodated. The filtered air in the convergence space 300 may be discharged to the outside of the air cleaner 1 again through the discharge assembly 800. The partition plates 131 and 132 may be provided to define the filtration space 200, which is an installation region for the filters 400*a* and 400*b* and the fans 500*a* and 500*b*, and the convergence space 300 in which the discharge assembly 800 is disposed.

Referring to FIGS. 3 and 6, the openings 141*a*, 141*b*, and 142 located on the lower side of the housing 100 may be formed on a lower end of the second body housing 112 after the first body housing 111 and the second body housing 112 are coupled to each other. The openings 141*a*, 141*b*, and 142 may be roughly classified into inlet openings 141*a* and 141*b* and an outlet opening 142. The inlet openings 141*a* and 141*b* and the outlet opening 142 may be defined by the partition plates 131 and 132.

The inlet openings 141*a* and 141*b* may correspond to the filtration space 200, and the outlet opening 142 may correspond to the convergence space 300. In other words, the inlet openings 141*a* and 141*b* are openings in which the filters 400*a* and 400*b* are disposed, and through which the air outside the air cleaner 1 passes through the filters 400*a* and 400*b* and flows into the filtration space 200. The filtration space 200 may be disposed at an upper end of the inlet openings 141*a* and 141*b*. The outlet opening 142 is an opening in which the discharge assembly 800 is disposed, and through which the filtered air of the convergence space 300 passes through the discharge assembly 800 and is discharged to the outside of the air cleaner 1. The convergence space 300 may be disposed at an upper end of the outlet opening 142.

The inlet openings 141*a* and 141*b* may include a first inlet opening 141*a* and a second inlet opening 141*b*. The first inlet opening 141*a* and the second inlet opening 141*b* may be defined by a housing rib 112*r* formed in the housing 100. The housing rib 112*r* may perform a function of assisting in air flow distribution to allow air passing through the filters 400*a* and 400*b* described later to be effectively introduced into the fans 500*a* and 500*b*. The housing rib 112*r* may be provided in a plate shape crossing the inlet openings 141*a* and 141*b*. However, it is not limited thereto, and may be provided in various shapes capable of effectively defining the first inlet opening 141*a* and the second inlet opening 141*b*.

The housing rib 112*r* may be formed across the first body housing 111 and the second body housing 112. However, it is not limited thereto, and after the housing rib 112*r* is formed only in the second body housing 112, the housing rib 112*r* may be linked to a structure of fan guards 113*a* and 113*b* and the flow paths 600*a* and 600*b* disposed in the second body housing 112, thereby defining the filtration space. The airflow passing through the filters 400*a* and 400*b* may be effectively distributed through the internal structure of the defined filtration space.

Particularly, the housing rib 112*r* may be formed in the second body housing 112 in which the openings 141*a*, 141*b*, and 142 are formed. The housing rib 112*r* may be formed to allow the first inlet opening 141*a* and the second inlet opening 141*b* to have substantially the same area. However, it is not limited thereto, and a single inlet opening 141*a* or 141*b* may be formed without the housing rib 112*r*.

The number of inlet openings 141*a* and 141*b* may correspond to the number of fans 500*a* and 500*b* provided inside the housing 100 of the air cleaner 1.

As for the air cleaner 1 according to the present embodiment, the fans 500*a* and 500*b* may be provided as a first fan 500*a* and a second fan 500*b* as will be described later. However, it is not limited thereto, and various numbers of fans 500*a* and 500*b* may be provided according to the volume of the space to be cleaned, and accordingly, the corresponding inlet openings 141*a* and 141*b* may be provided in various numbers. Further, the above-described housing ribs 112*r* may be formed in the number corresponding to the number of inlet openings 141*a* and 141*b*.

The housing 100 may further include an edge plate 120 corresponding to an edge of the body housing 110 described above. Particularly, the body housing 110 may further include the edge plate 120 coupled to the lower side of the second body housing 112. The edge plate 120 may be provided in a shape corresponding to a lower edge 112*e* of the second body housing 112. The lower edge of the second body housing 112 may refer to an edge 112*e* of the second body housing 112 forming the openings 141*a*, 141*b*, and 142.

The edge plate 120 may support the filters 400*a* and 400*b* and be coupled to the lower side of the housing 100. The edge plate 120 may support the discharge assembly and may be coupled to the lower side of the housing 100. This will be described in detail later.

The edge plate 120 may be formed to correspond to the edge 112*e* of the body housing 110, and thus may be provided in a substantially rectangular ring shape. However, it is not limited thereto, and the edge plate 120 may be provided in various shapes to correspond to the edge 112*e* of the body housing 110.

The edge plate 120 may further include an edge plate rib 121 to effectively support the filters 400*a* and 400*b*. The edge plate rib 121 may increase a structural rigidity of the edge plate 120. The edge plate rib 121 may be formed at a position corresponding to the housing rib 112*r*. The edge plate rib 121 may be formed at a position corresponding to the partition plates 131 and 132.

The edge plate rib 121 may be provided in a rod shape connecting facing edges of the edge plate 120. However, it is not limited thereto and the edge plate rib 121 may be provided in various shapes capable of improving the structural rigidity of the edge plate 120.

The second body housing 112 and the edge plate 120 may be coupled through a fastening member (not shown). The fastening member (not shown) may be provided in a screw fastening method or a hook fastening method. However, it is not limited thereto, and various fastening methods capable of firmly maintaining a state, in which the second body housing 112 is vertically fastened to the edge plate 120, may be applied.

A sensor 20 may be arranged on a side of the edge plate 120. The sensor 20 may be disposed in a position close to the electrical portion 700 of the air cleaner 1, but the sensor 20 of the air cleaner 1 according to one embodiment of the present disclosure may be arranged on another side of the edge plate 120 opposite to the side of the edge plate 120 on which the electrical portion 700 is arranged. However, the position of the sensor 20 is not limited thereto, and may be installed in various positions of the air cleaner 1 capable of effectively measuring a contamination level of a space to be cleaned.

The filters 400*a* and 400*b* may be installed in the inlet openings 141*a* and 141*b*. The filter may purify air introduced into the housing 100 of the air cleaner 1 from the outside of the air cleaner 1. The filters 400*a* and 400*b* may be disposed at the inlet openings 141*a* and 141*b* and may be fixed to the housing 100. The filters 400*a* and 400*b* may be fixed to the housing 100 by the edge plate 120 of the housing 100. The filters 400*a* and 400*b* may be provided to correspond to the shapes of the inlet openings 141*a* and 141*b*. A cross-sectional shape of the filters 400*a* and 400*b* may be formed in a substantially rectangular shape.

The filters 400*a* and 400*b* may include a first filter 400*a* and a second filter 400*b*. In other words, the filters 400*a* and 400*b* may be provided with a plurality of filters. The filters 400*a* and 400*b* may be provided in plurality in accordance with to the shape or number of the inlet openings 141*a* and 141*b*. As described above, the air cleaner 1 according to the present embodiment is provided with two inlet openings such as the first inlet opening 141*a* and the second inlet opening 141*b*, and thus the filters 400*a* and 400*b* may be provided correspondingly thereto. However, it is not limited thereto and the filter may be provided as a single filter. That is, a single filter may be provided regardless of the shape or number of inlet openings 141*a* and 141*b*.

The fans 500*a* and 500*b* may be installed inside the housing 100. The fans 500*a* and 500*b* may move air, which passes through the filters 400*a* and 400*b*, from the filtration space 200 to the convergence space 300.

The fans 500*a* and 500*b* may be provided in the shape of an approximate cylinder having a short height than a diameter. The fans 500*a* and 500*b* may further include a fan motor 510 configured to drive the fans 500*a* and 500*b* and arranged at a position corresponding to the center of the aforementioned cylinder. The fan applied to one embodiment of the present disclosure may be provided as a centrifugal fan. However, it is not limited thereto, and various types of fans such as an axial fan may be applied according to the overall shape of the air cleaner 1 and the arrangement structure of the flow path.

The air cleaner 1 according to one embodiment of the present disclosure may include a plurality of fans. Referring to FIG. 3, the air cleaner 1 according to one embodiment of the present disclosure may include a first fan 500*a* and a second fan 500*b*.

In comparison with the second fan 500*b*, the first fan 500*a* may be disposed inside the housing further away from the outlet opening 142. The aforementioned first inlet opening 141*a* and second inlet opening 141*b* may correspond to the first fan 500*a* and the second fan 500*b*, respectively. However, it is not limited thereto and one fan or two or more fans may be provided.

The fan guards 113*a* and 113*b* may be provided inside the housing 100. The flow paths 600*a* and 600*b* connected to the fan guards 113*a* and 113*b* may be provided inside the housing 100. The fan guards 113*a* and 113*b* and the flow paths 600*a* and 600*b* according to one embodiment of the present disclosure may be separately manufactured and then coupled to the housing 100. Particularly, the fan guards 113*a* and 113*b* and the flow paths 600*a* and 600*b* may be coupled to a surface positioned at an upper end of the first housing 100. However, it is not limited thereto, and the fan guards 113*a* and 113*b* and the flow paths 600*a* and 600*b* may be disposed inside the housing and integrally formed with the housing 100.

The fan guards 113*a* and 113*b* may have shapes corresponding to the fans 500*a* and 500*b*. The fan guards 113*a* and 113*b* may be provided in a shape surrounding the fans 500*a* and 500*b*. The fan guards 113*a* and 113*b* may be formed in a substantially hemispherical shape. The fan guards 113*a* and 113*b* may serve to transfer air, which is discharged in a circumferential direction of the fans 500*a* and 500*b* provided as centrifugal fans, to the flow path. The fan guards 113*a* and 113*b* may include a hollow arranged at a position facing the inlet openings 141*a* and 141*b* so as to allow air, which passes through the filter, to be introduced.

The fan guards 113*a* and 113*b* may be provided in plurality to correspond to the number of fans 500*a* and 500*b*. Because the air cleaner 1 according to one embodiment of the present disclosure includes the above-described first fan 500*a* and second fan 500*b*, the fan guards 113*a* and 113*b* may be provided as a first fan guard 113*a* and a second fan guard 113*b* to correspond to the number of the fans. Referring to FIG. 3, the first fan guard 113*a* and the second fan guard 113*b* may have the same shape.

The flow paths 600*a* and 600*b* may be connected to the fan guards 113*a* and 113*b*. Air discharged from the fans 500*a* and 500*b* may flow into the flow paths 600*a* and 600*b* through the fan guards 113*a* and 113*b*.

The flow paths 600*a* and 600*b* may be provided in plurality to correspond to the number of fans 500*a* and 500*b*. Because the air cleaner 1 according to one embodiment of the present disclosure includes the above-described first fan 500*a* and second fan 500*b*, the flow paths 600*a* and 600*b* may be provided as a first flow path 600*a* and a second flow path 600*b* to correspond to the number of the fans 500*a* and 500*b*. The first flow path 600*a* and the second flow path 600*b* may be disposed inside the housing 100. Particularly, the first flow path 600*a* and the second flow path 600*b* may be disposed inside the first body housing 111.

Referring to FIGS. 3 to 6, the first flow path 600*a* and the second flow path 600*b* may extend from the first fan guard 113*a* and the second fan guard 113*b*, respectively. A length of the first flow path 600*a* connected to the first fan guard 113*a* may be less than a length of the second flow path 600*b* connected to the second fan guard 113*b*. The first flow path 600*a* and the second flow path 600*b* may be vertically stacked to increase space utilization inside the housing 100. The first flow path 600*a* may be positioned below the second flow path 600*b*. The first flow path 600*a* may be formed in such a way that a part of an upper surface forming the first flow path 600*a* overlaps a part of a lower surface of the second flow path 600*b*.

Together with the partition plates 131 and 132, a wall forming the flow paths 600*a* and 600*b* may define the convergence space 300 and the filtration space 200. The filtration space 200 and the convergence space 300 may communicate with each other through the flow paths 600*a* and 600*b*.

Air passing through the flow paths 600*a* and 600*b* may be discharged into the convergence space 300 through flow path outlets 610*a* and 610*b* formed at one end of the flow paths 600*a* and 600*b*. The first flow path outlet 610*a* may be formed at one end of the first flow path 600*a*. The second flow path outlet 610*b* may be formed at one end of the second flow path 600*b*.

Referring to FIG. 5, because the first flow path 600*a* is disposed below the second flow path 600*b*, the first flow path outlet 610*a* of the first flow path 600*a* may be disposed below the second flow path outlet 610*b* of the second flow path 600*b*. The filtered air may be discharged into the convergence space 300 through the first flow path outlet 610*a* and the second flow path outlet 610*b*.

A discharge direction D2 of air discharged through the first flow outlet 610*a* and a discharge direction D1 of air discharged through the second flow outlet 610*b* may be different from each other. Particularly, discharge direction D1 may be formed approximately 90° to discharge direction D2.

The discharge direction D2 of the air discharged through the first flow path outlet 610*a* may face an electrical portion arrangement region 700'. The discharge direction D1 of the air discharged through the second flow outlet 610*b* may be provided in parallel with the electrical portion arrangement region 700'. That is, the discharge direction D1 of the air discharged through the second flow outlet 610*b* may not face the electrical portion arrangement region 700'.

Referring to FIGS. 5 and 6, an energy recovery ventilator (ERV) communication port 900 provided to communicate with an energy recovery ventilator (ERV) arranged on the outside of the air cleaner 1 may be arranged on one side of the housing 100. The ERV may refer to a heat exchanger configured, when indoor air is discharged to the outside for ventilation, to take energy (heat) from the indoor air and transfer the energy (heat) to outdoor air that is introduced from the outside.

In the air cleaner according to one embodiment of the present disclosure, the outside air of the air cleaner 1 discharged from the ERV may flow into the air cleaner 1 through the ERV communication port 900.

The air, which is introduced into the inside of the air cleaner 1 through the ERV communication hole 900 may flow into the air cleaner 1 through an outside air flow path 910.

Figure 7:
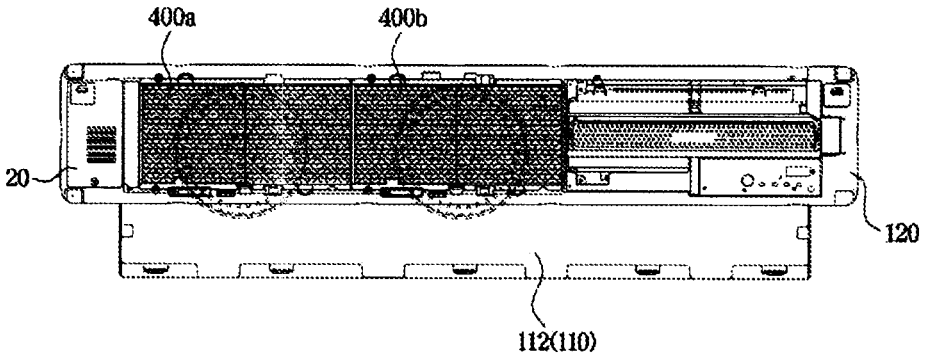
FIG. 7 is a bottom view illustrating the air cleaner according to one embodiment of the present disclosure when the grille is removed.
Figure 8:
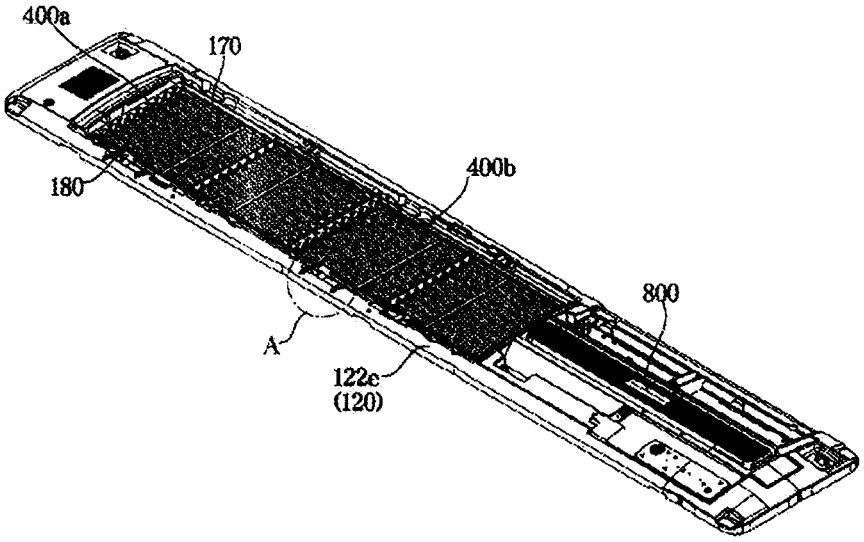
FIG. 8 is a view illustrating an edge plate including a locking portion of the air cleaner of FIG. 7 and a filter.
Figure 9:
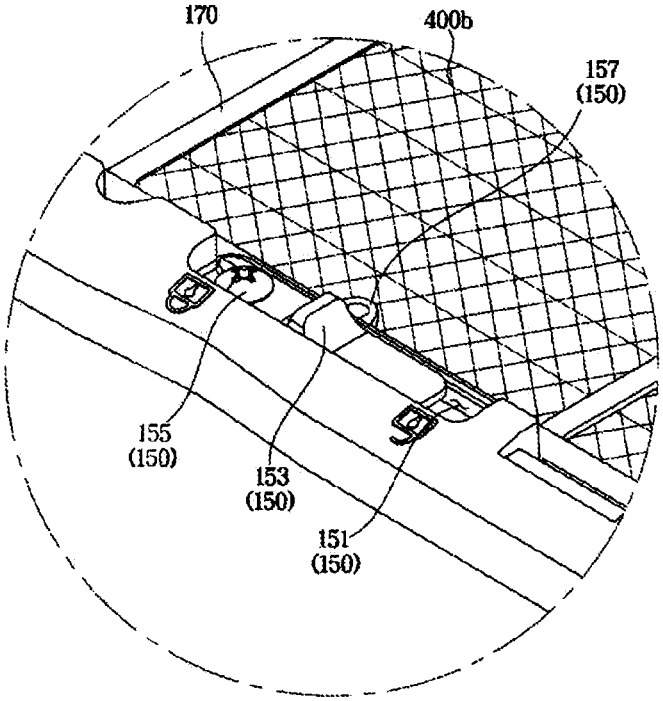
FIG. 9 is an enlarged view illustrating the edge plate including the locking portion of FIG. 8 and the filter.
Figure 10:
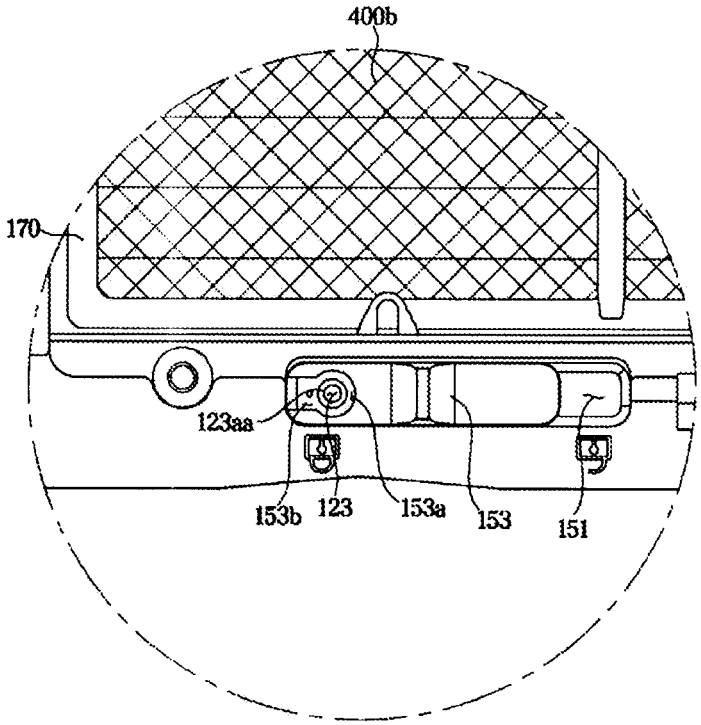
FIG. 10 is a view illustrating the locking portion of FIG. 9 from which a fitting member is removed.
Figure 11:
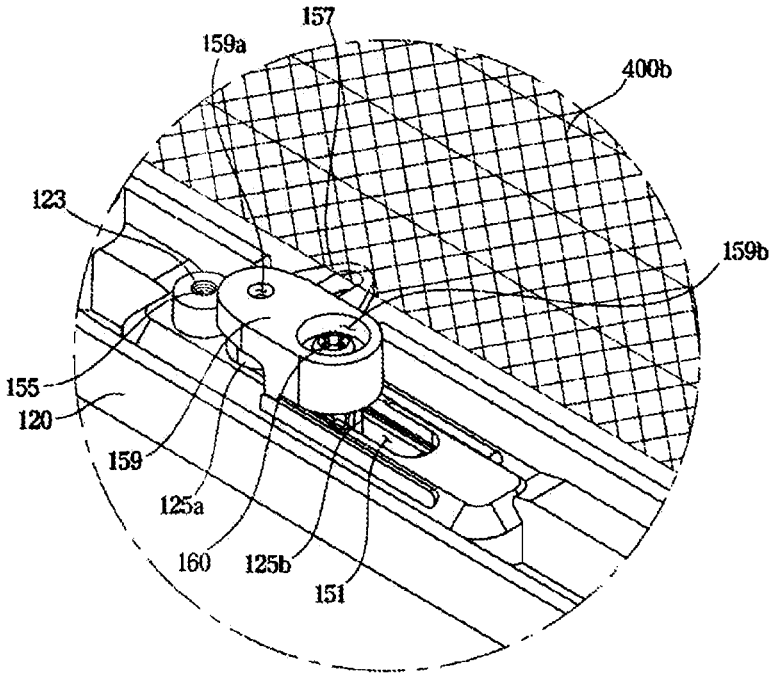
FIG. 11 is a view illustrating a rear surface of the edge plate and the filter of FIG. 9.
Figure 12:
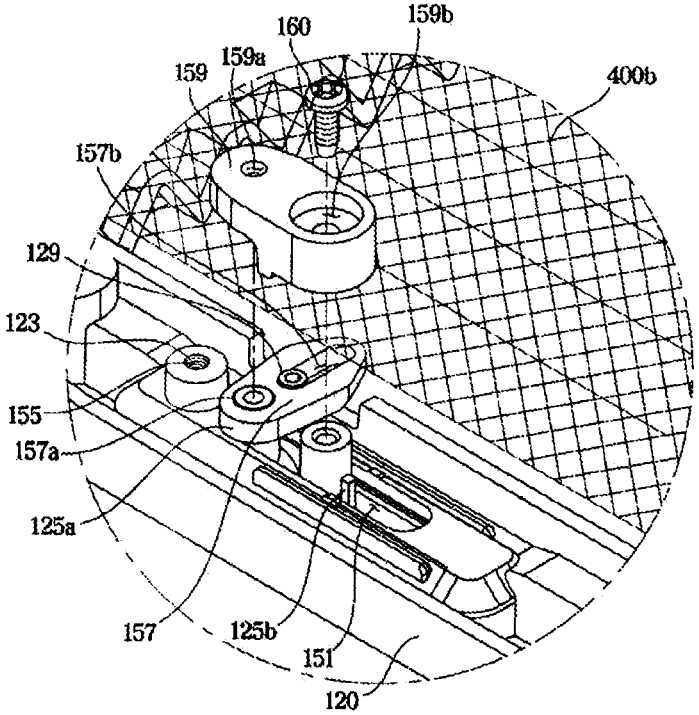
FIG. 12 is a view illustrating a state in which a support member is separated from the rear surface of the edge plate of FIG. 11.

FIG. 7 is a bottom view illustrating the air cleaner according to one embodiment of the present disclosure when the grille is removed, FIG. 8 is a view illustrating an edge plate including a locking portion of the air cleaner of FIG. 7 and a filter, FIG. 9 is an enlarged view illustrating the edge plate including the locking portion of FIG. 8 and the filter, FIG. 10 is a view illustrating the locking portion of FIG. 9 from which a fitting member is removed, FIG. 11 is a view illustrating a rear surface of the edge plate and the filter of FIG. 9, and FIG. 12 is a view illustrating a state in which a support member is separated from the rear surface of the edge plate of FIG. 11.

FIG. 7 illustrates a state in which a portion of the second body housing 112, which corresponds to a region in which the flow path outlets 610*a* and 610*b* of the flow paths 600*a* and 600*b* are positioned, is removed.

Hereinafter the edge plate 120 including a locking portion 150 will be described in detail.

Referring to FIGS. 7 and 8, the filters 400*a* and 400*b* are arranged on one side of the inlet openings 141*a* and 141*b* (hereinafter referred to as 'openings') of the housing 100. In a state in which the air cleaner 1 is installed on the ceiling, the filter 400 is fixed by the locking portion 150 so as not to fall downward. The locking portion 150 may be provided on a side of the edge 122*e* of the edge plate 120.

Particularly, referring to FIG. 9, the locking portion 150 includes a space portion 151, a sliding member 153, a fitting member 155 and a link 157.

The space portion 151 forms a space inside the edge plate 120. The space portion 151 provides a space to allow the sliding member 153 to be located inside and to slide within or along the space portion 151.

The sliding member 153 slides along the space portion 151. The sliding member 153 may slide in a first direction x or a second direction −x along the space portion 151. This will be described later.

Referring to FIG. 10, a fastening hole 123 forming a groove to be recessed inward of the space portion 151 to be deeper than the space portion 151 may be provided in the edge plate 120. The fitting member 155 is fastened to the fastening hole 123. The fitting member 155 may include a body 155*a* and a head 155*b* having a larger diameter than the body 155*a*. The fitting member 155 may be a general screw. A first screw thread 155*aa* may be provided on an outer surface of the body 155*a*, and a second screw thread 123*aa* corresponding to the first screw thread 155*aa* (refer to FIG. 13) may be provided on an inner surface of the fastening hole 123.

The sliding member 153 includes through grooves 153*a* and 153*b*. That is, the sliding member 153 includes a first through hole 153*a* and a second through hole 153*b*. The first through hole 153*a* is provided to correspond to the head 155*b* of the fitting member 155. The second through hole 153*b* is connected to the first through hole 153*a* and is provided to be smaller than the first through hole 153*a* and larger than the body 155*a*.

In a state in which the filters 400*a* and 400*b* are locked to the housing 100, a first end of the sliding member 153 may be placed in contact with an end of the space portion 151. That is, the sliding member 153 may be positioned to allow the first through hole 153*a* to overlap the fastening hole 123 of the edge plate 120. Accordingly, the fitting member 155 may pass through the first through hole 153*a* and be fastened to the fastening hole 123.

The first through hole 153*a* of the fitting member is provided in a size corresponding to the head 155*b* of the fitting member 155. Accordingly, when the fitting member 155 is inserted into the fastening hole 123 to allow the head 155*b* to be positioned at the first through hole 153*a*, the sliding member 153 may be fixed to the edge plate 120.

Referring to FIGS. 11 and 12, the link 157 may be provided to be coupled to the sliding member 153 on the rear surface of the edge plate 120. A first shaft coupler 125*a* penetrating the space portion 151 is provided on a rear surface of the sliding member 153. The link 157 includes a through hole 157*a* through which the first shaft coupler 125*a* passes. The link 157 may be rotatably coupled to the sliding member 153 by being inserted into the first shaft coupler 125*a* through the through hole 157*a*. When the sliding member 153 slides, the link 157 may rotate about the first shaft coupler 125*a*.

In a state in which the edge plate 120 locks the filters 400*a* and 400*b*, the link 157 may be positioned to overlap one surface of the filters 400*a* and 400*b* to fix the filters. In this case, the link 157 may be positioned to extend in a vertical direction with respect to the edge 122*e* of the edge plate 120.

A guide protrusion 129 having a protrusion shape may be provided on the rear surface of the edge plate 120. The guide protrusion 129 may be provided in a cylindrical shape. The guide protrusion 129 may be provided adjacent to the space portion 151 as shown. The link 157 may include a guide hole 157*b* having a long shape so to allow the guide protrusion 129 to be inserted therein. When a side of the link 157 is coupled to the sliding member 153 through the first shaft coupler 125*a*, and when the sliding member 153 slides, the link 157 may move together with the sliding member 153. In this case, the other side of the link 157 provided with the guide hole 157*b* may be guided by the guide protrusion 129 and rotated.

The guide protrusion 129 may limit the rotation of the link 157 to allow the link 157 to rotate within a predetermined range, according to the sliding of the sliding member 153. Accordingly, when the sliding member 153 moves in the first direction x, the link 157 may be rotated so as not to overlap with the filter 400*b*, and in this state, when the sliding member 153 moves in the second direction −x, the link 157 may be rotated to overlap with the filter 400*b* and returned to its original position.

As will be described later, when the sliding member 153 moves in the first direction x to unlock the filters 400*a* and 400*b*, one side of the link 157 coupled to the first shaft coupler 125*a* may be moved together with the sliding member 153 and the other side of the link 157 through which the guide protrusion 129 passes may be rotated not to overlap with the filters 400*a* and 400*b*. Accordingly, when the maintenance or replacement of the filters 400*a* and 400*b* is required, a user can separate the filters 400*a* and 400*b* from the housing 100.

The locking portion 150 may further include a support member 159 provided to support the link 157 to allow the link 157 to stably rotate around the first shaft coupler 125*a* of the sliding member 153. A first side of the support member 159 may be coupled to the first shaft coupler 125*a* to support the link 157, and a second side of the support member 159 may be coupled to a second shaft coupler 125*b* of the sliding member 153 so as to move together with the sliding member 153. A first coupling hole 159*a* for coupling with the first shaft coupler 125*a* may be provided at the first side of the support member 159.

The second shaft coupler 125*b* provided on the rear surface of the sliding member 153 may be provided to pass through the space portion 151 in the same manner as the first shaft coupler 125*a*. A second coupling hole 159*b* for coupling with the second shaft coupler 125*b* may be provided on the second side of the support member 159, and the fastening screw 160 may penetrate the second coupling hole 159*b* to be coupled to the second shaft coupler 125*b*, thereby the support member 159 is coupled to the sliding member 153.

Accordingly, the support member 159 may move together with the sliding member 153 through the second shaft coupler 125*b* and at the same time, the support member 159 may support the link 157 to allow the link 157 to stably rotate with respect to the first shaft coupler 125*a*.

Further, the air cleaner 1 may further include an auxiliary frame 170 provided between the edge plate 120 and the filters 400*a* and 400*b* to cover the edges of the filters 400*a* and 400*b*. The auxiliary frame 170 may be disposed on the rear side of the link 157 and fixed by the link 157 together with the filters 400*a* and 400*b*, and may support the edges of the filters 400*a* and 400*b*. When a user is to remove the filters 400*a* and 400*b* from the housing 100, the user can first separate the auxiliary frame 170 and then remove the filters 400*a* and 400*b*.

Further, the air cleaner 1 may further include a fixing frame 180 (refer to FIG. 8) coupled to the edge plate 120 and disposed on the front side of the auxiliary frame 170. The fixing frame 180 is provided to be fixed to the edge plate 120 to prevent the auxiliary frame 170 and the filters 400*a* and 400*b* from falling downward in the state in which the air cleaner 1 is installed on the ceiling.

Figure 13:
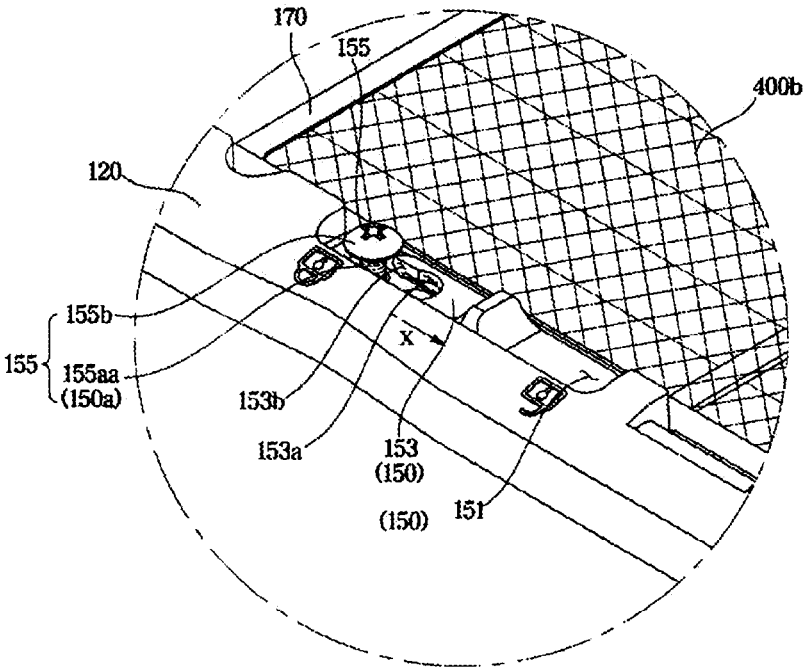
FIG. 13 is a view illustrating a state in which a sliding member of the locking portion of FIG. 9 slides in a first direction.
Figure 14:
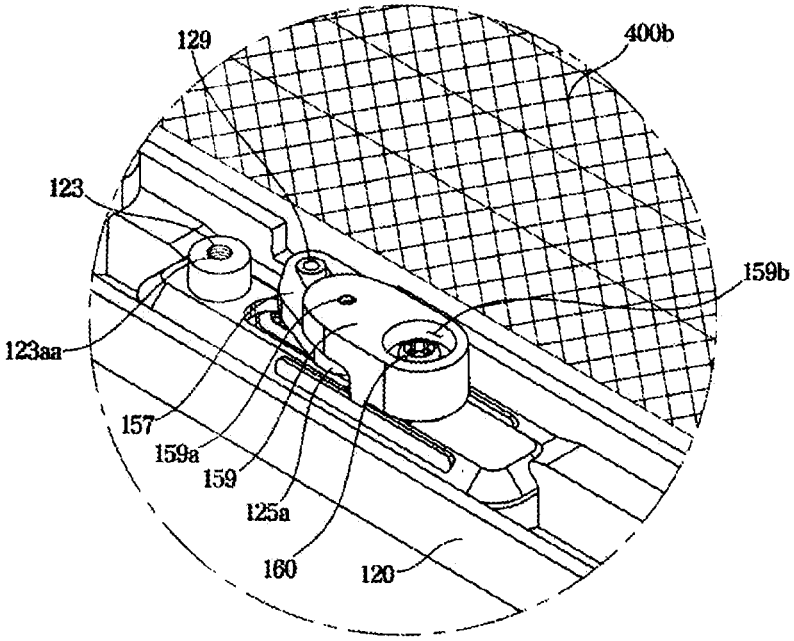
FIG. 14 is a view illustrating the rear surface of the edge plate and the filter when the sliding member of FIG. 13 slides.
Figure 15:
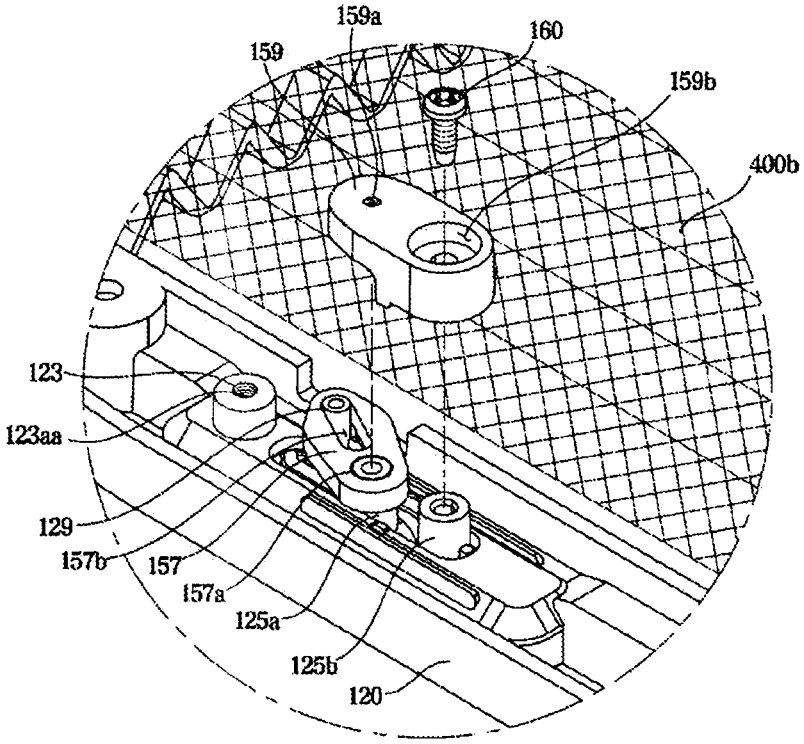
FIG. 15 is a view illustrating a state in which the support member is separated from the rear surface of the edge plate of FIG. 14.

FIG. 13 is a view illustrating a state in which a sliding member of the locking portion of FIG. 9 slides in a first direction, FIG. 14 is a view illustrating the rear surface of the edge plate and the filter when the sliding member of FIG. 13 slides, and FIG. 15 is a view illustrating a state in which the support member is separated from the rear surface of the edge plate of FIG. 14.

Referring to FIG. 13, in order to release the fixing of the sliding member 153 to allow the sliding member 153 to slide, the fitting member 155 may be moved upward from the fastening hole 123. By rotating the fitting member 155, the head 155*b* may protrude more than the first through hole 153*a*. In this case, because the body 155*a* of the fitting member 155 is provided to have a smaller diameter than the first through hole 153*a* and the second through hole 153*b* of the sliding member 153, the sliding member 153 may move in the first direction x.

At this time, as the body 155*a* is fastened to the fastening hole 123 and the fitting member 155 is moved in a certain extent to allow the head 155*b* to protrude from the first through hole 153*a* while the fitting member 155 is not completely separated from the fastening hole 123, the sliding member 153 may be moved. In this case, it is not required to re-couple the fitting member 155 to the fastening hole 123 because the fitting member 155 is not completely separated or removed. Further, it is possible to prevent an accident in which a user is injured by the fitting member 155 that is separated from the housing 100 and falls downward.

As shown in FIG. 13, the sliding member 153 may be moved in the first direction x until the second end of the sliding member 153 reaches the other end of the space portion 151. In this case, the link 157 may be rotated along the guide protrusion 129 and thus the link 157 may not overlap with a portion of the filters 400*a* and 400*b*. Accordingly, the filters 400*a* and 400*b* may be separated or removed from the housing 100.

Particularly, referring to FIGS. 14 and 15, when the sliding member 153 moves in the first direction x, the link 157 coupled to the first shaft coupler 125*a* may be rotated with respect to the first shaft coupler 125*a* along the guide protrusion 129. That is, the link 157 may be rotated so as to be positioned in an oblique direction with respect to the edge 122*e* of the edge plate 120 in the state in which the link 157 is positioned vertically with respect to the edge 122*e* of the edge plate 120.

At this time, a user separates or removes the filters 400*a* and 400*b* from the housing 100 to perform maintenance work on the filters 400*a* and 400*b* or replace the filters 400*a* and 400*b* with new filters 400*a* and 400*b*.

When the maintained filters 400*a* and 400*b* or the new filters 400*a* and 400*b* are coupled to the housing 100 again, the link 157 is positioned vertically with respect to the edge 122*e* of the edge plate 120 after the filters 400*a* and 400*b* are arranged in the housing 100. For this, the sliding member 153 may be moved in the second direction −x. That is, it is possible to move the sliding member 153, in which the other end overlaps the other end of the space portion 151 as shown in FIG. 13, to the second direction −x to allow the first end of the sliding member 153 to overlap the other end of the space portion 151 as shown in FIG. 9.

When the sliding member 153 is moved in the second direction −x, the link 157 may be rotated from a position of being in an oblique direction with respect to the edge 122*e* of the edge plate 120 to a position of being in the vertical direction.

When the sliding member 153 is positioned to allow the first end of the sliding member 153 to overlap one end of the space portion 151, the fitting member 155 may be inserted into the fastening hole 123 to allow the head 155*b* to be positioned in the first through hole 153*a*, thereby fixing the sliding member 153 to the edge plate 120.

As described above, the filters 400*a* and 400*b* may be fixed by the link 157 and the sliding member 153 may be fixed to the edge plate 120.

While the present disclosure has been particularly described with reference to exemplary embodiments, it should be understood by those of skilled in the art that various changes in form and details may be made without departing from the spirit and scope of the present disclosure.

Although the present disclosure has been described with various embodiments, various changes and modifications may be suggested to one skilled in the art. It is intended that the present disclosure encompass such changes and modifications as fall within the scope of the appended claims.

What is claimed is:

1. A ceiling type air cleaner, comprising:

a housing comprising an opening arranged on a lower side of the housing;

a filter arranged on a side of the opening; and an edge plate arranged on the lower side of the housing to support the filter and comprising a locking portion configured to lock the filter to the housing and unlocked the filter from the housing, wherein the locking portion comprises:

a space portion forming a space inside the edge plate;

a sliding member configured to slide along the space portion; and a link configured to rotate when the sliding member moves, wherein rotating in a first direction causes a portion of the link to overlap the filter and locks the filter to the housing and rotating in a second direction causes the portion of the link to not overlap the filter and unlocks the filter from the housing.

2. The ceiling type air cleaner of claim 1, further comprising:

a fitting member configured to allow the sliding member to slide by being fixed to or released from the space portion, wherein the edge plate includes a fastening hole configured to receive the fitting member so as to fasten the fitting member at the space portion.

3. The ceiling type air cleaner of claim 2, wherein:

the fitting member comprises:

a body inserted into the fastening hole; and a head having a larger diameter than the body, and the sliding member comprises:

a first through hole provided to correspond to the head of the fitting member; and a second through hole connected to the first through hole and provided to be smaller than the first through hole and larger than the body.

4. The ceiling type air cleaner of claim 3, wherein:

a first screw thread is provided on an outer surface of the body of the fitting member; and a second screw thread corresponding to the first screw thread is provided on an inner surface of the fastening hole.

5. The ceiling type air cleaner of claim 4, wherein in response to inserting the fitting member into the fastening hole in a manner that the head of the fitting member is positioned in the first through hole, the sliding member is fixed to the space portion.

6. The ceiling type air cleaner of claim 5, wherein in response to moving the fitting member from the fastening hole to allow the head of the fitting member to protrude from the first through hole, the sliding member slides in a first direction along the space portion.

7. The ceiling type air cleaner of claim 6, wherein the link is configured to couple to a first shaft coupler of the sliding member on a rear surface of the edge plate, and is rotated with respect to the first shaft coupler.

8. The ceiling type air cleaner of claim 7, wherein:

a guide protrusion configured to limit rotation of the link is arranged on the rear surface of the edge plate, wherein the link comprises a guide hole into which the guide protrusion is fitted.

9. The ceiling type air cleaner of claim 8, wherein:

the portion of the link overlaps the filter in a state in which the sliding member is fixed; and in response to the sliding member sliding in the first direction, the link is configured to rotate so the portion of the link does not overlap the filter and the filter is released.

10. The ceiling type air cleaner of claim 9, wherein the locking portion further comprises a support member provided in such a way that a first side thereof is coupled to the first shaft coupler to support the link and a second side thereof is coupled to a second shaft coupler of the sliding member so as to move together with the sliding member.

11. The ceiling type air cleaner of claim 9, wherein in response to the sliding member sliding in a second direction opposite to the first direction, the link is configured rotate to a position with the portion of the link overlapping the filter.

12. The ceiling type air cleaner of claim 11, wherein in response to fastening the fitting member to the fastening hole to allow the head to be positioned in the first through hole, the link is configured to support the filter.

13. The ceiling type air cleaner of claim 12, further comprising:

an auxiliary frame arranged on a rear side of the link to support an edge of the filter.

14. The ceiling type air cleaner of claim 13, further comprising:

a fixing frame fixed to the auxiliary frame to be arranged on a front side of the link so as to fix the auxiliary frame and the filter.

15. The ceiling type air cleaner of claim 1, wherein:

the opening comprises a plurality of openings, the housing comprises a housing rib provided to define the plurality of openings, and the edge plate comprises an edge plate rib provided at a position corresponding to the housing rib.

16. A ceiling type air cleaner including:

a housing including a plurality of openings arranged on a lower side of the housing;

a filter arranged on a side of the plurality of openings;

a fan configured to move air passing through the filter; and an edge plate provided to correspond to an edge of the housing formed along the plurality of openings, wherein the edge plate includes a locking portion configured to lock the filter to the housing and unlock the filter from the housing, and wherein the locking portion includes:

a sliding member; and a link configured to rotate when the sliding member moves, wherein rotating the link in a first direction causes a portion of the link to overlap the filter and locks the filter to the housing and rotating the link in a second direction causes the portion of the link to not overlap the filter and unlocks the filter from the housing.

17. The ceiling type air cleaner of claim 16, where the locking portion includes a fitting member that is not completely disassembled when unlocking the filter so as to prevent the fitting member from falling.

18. The ceiling type air cleaner of claim 16, wherein:

the housing includes a housing rib provided to define the plurality of openings, and the edge plate includes an edge plate rib provided at a position corresponding to the housing rib.

* * * * *